United States Patent [19]

Masuda

[11] Patent Number: 4,569,585

[45] Date of Patent: Feb. 11, 1986

[54] IMAGE FORMING APPARATUS

[75] Inventor: Shunichi Masuda, Kawasaki, Japan

[73] Assignee: Canon Kabushiki Kaisha, Tokyo, Japan

[21] Appl. No.: 503,235

[22] Filed: Jun. 10, 1983

[30] Foreign Application Priority Data

| | | | |
|---|---|---|---|
| Jun. 17, 1982 | [JP] | Japan | 57-103090 |
| Jun. 17, 1982 | [JP] | Japan | 57-103091 |
| Jun. 17, 1982 | [JP] | Japan | 57-103092 |
| Jun. 17, 1982 | [JP] | Japan | 57-103093 |
| Jun. 17, 1982 | [JP] | Japan | 57-103094 |

[51] Int. Cl.[4] ..... G03G 15/28

[52] U.S. Cl. ..... 355/14 R; 355/14 C; 355/3 R

[58] Field of Search ..... 355/14 R, 14 C, 3 R; 363/52, 53; 307/116, 130, 140, 141

[56] References Cited

U.S. PATENT DOCUMENTS

| | | | |
|---|---|---|---|
| 3,575,107 | 4/1971 | McDowell | 307/130 X |
| 3,819,266 | 6/1974 | Price | 355/14 R X |
| 3,999,851 | 12/1976 | Sakamaki et al. | 355/14 R |
| 4,048,666 | 9/1977 | Irie et al. | 355/14 R X |
| 4,092,711 | 5/1978 | Gerding et al. | 363/53 |
| 4,144,550 | 3/1979 | Donohue et al. | 355/14 C X |
| 4,392,741 | 7/1983 | Inuzuka et al. | 355/14 R |

FOREIGN PATENT DOCUMENTS

| | | | |
|---|---|---|---|
| 0114247 | 9/1979 | Japan | 355/14 C |
| 0000667 | 1/1982 | Japan | 355/14 R |
| 0000666 | 1/1982 | Japan | 355/14 R |
| 0108862 | 7/1982 | Japan | 355/14 C |
| 0196267 | 12/1982 | Japan | 355/14 C |

*Primary Examiner*—William M. Shoop, Jr.
*Assistant Examiner*—Shik Luen Paul Ip
*Attorney, Agent, or Firm*—Fitzpatrick, Cella, Harper & Scinto

[57] ABSTRACT

An image forming apparatus has a control unit which controls an image forming unit in accordance with a detection signal from an abnormal power condition detector which detects an abnormal condition of a power suply such as a voltage drop or a momentary break. The control unit stops the image forming unit a predetermined time period after the detection of the abnormal condition of the power.

9 Claims, 15 Drawing Figures

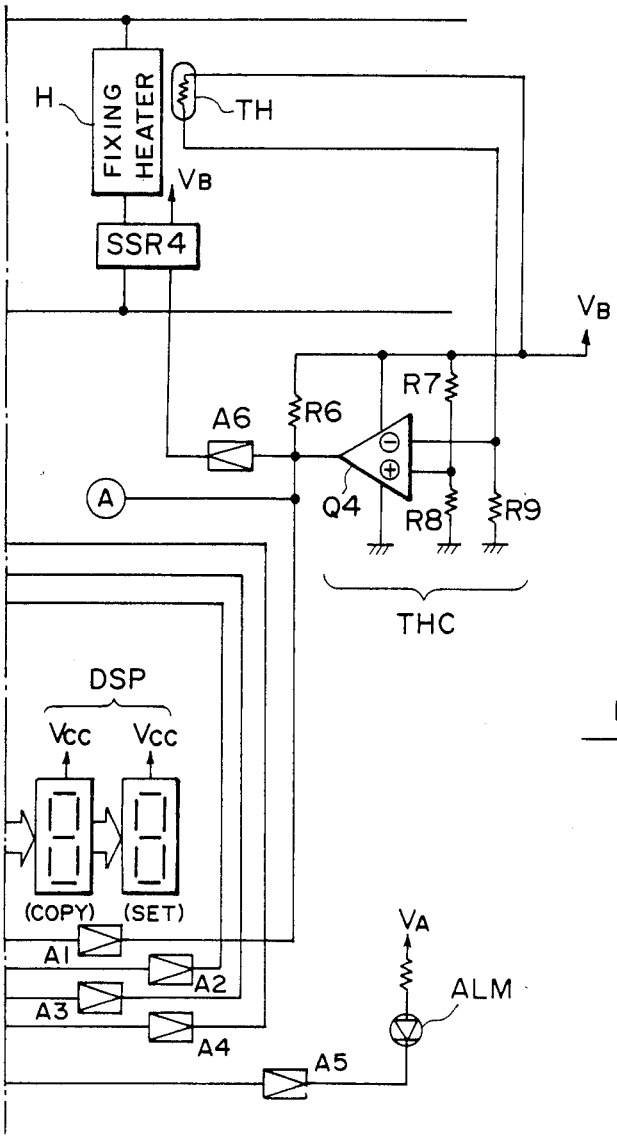
FIG. 2c
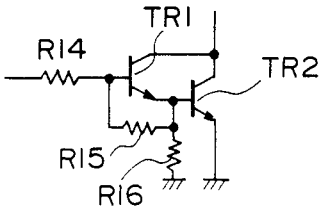
FIG. 2A
| FIG. 2a | FIG. 2b | FIG. 2c |
|---|---|---|
FIG. 2

IMAGE FORMING APPARATUS

BACKGROUND OF THE INVENTION

1. Field of the Invention

The present invention relates to an image forming apparatus such as a copying machine, a printer or a laser beam printer, and more particularly to an image forming apparatus having a function to countermeasure an abnormal condition of a power supplied to the apparatus.

2. Description of the Prior Art

Recent image forming apparatus are controlled by digital IC's, most of which are microcomputers. In an A.C. power line voltage drops or momentarily broken during the operation of the image forming apparatus such as a recorder, the microcomputer malfunctions and the recorder is significantly influenced or a satisfactory image is not produced on a record medium or a record paper. In a worst case, the recorder is broken. In the prior art, in order to prevent such an inconvenience, means for automatically resetting the microcomputer when the voltage drop or momentary break of the power supply occurs so that the control is resumed from an initial state has been proposed. However, when the microcomputer is reset during the record operation, a setting such as the number of records changes from the initial setting and the number of records must be set again in accordance with the number of records finished and the record papers remaining in the apparatus must be removed. Such a post-processing is troublesome. When the microcomputer is reset during the record operation, all output ports are reset and the record operation is stopped. In a copying machine, for example, if the operation is stopped during the application of a predetermined latent image potential by a corona discharge to form a latent image on a photosensitive drum, an non-uniform latent image potential remains on the photosensitive drum, and in the next copying cycle, the previous copy image appears in superposition to a new copy image.

In the copying machine, the record paper under copy remains in the machine. If the record operation is stopped when the record paper is passing through a heater roller of a fixing unit and the record operation is resumed after the power has been recovered, the record paper wrapped around the heater roller is burnt, and in a worst case, a fire accident may occur.

If the microcomputer is reset when the voltage drop or the momentary break of the power occurs at a very short interval such as noise on the power line, the microcomputer is too frequently reset although the record operation is not effectively influenced by such voltage drop or momentarily break. Thus, a normal record operation cannot be continued.

SUMMARY OF THE INVENTION

It is an object of the present invention to provide an image forming apparatus which countermeasures to an abnormal condition of a power supply such as a voltage drop or momentary break but does not respond to an abnormal condition of the power supply of a very short period which does not effectively affect to an image forming operation.

It is another object of the present invention to provide an image forming apparatus which countermeasures to an abnormal condition of a power supply such as a voltage drop or a momentary break to prevent any trouble in an image forming operation to be resumed after the recovery of a normal condition of the power supply.

It is another object of the present invention to provide an image forming apparatus which countermeasures to an abnormal condition of a power supply such as a voltage drop or a momentary break and automatically resumes an image forming operation after the recovery of a normal condition of the power supply or continues a stop status.

It is another object of the present invention to provide an image forming apparatus which countermeasures to an abnormal condition of a power supply and resumes an image forming operation after a record paper remained in the apparatus has been ejected when a normal condition of the power supply is recovered.

It is another object of the present invention to provide an image forming apparatus which countermeasures to an abnormal condition of a power supply a predetermined period after such an abnormal condition occurred.

It is another object of the present invention to provide an image forming apparatus which countermeasures to an abnormal condition of a power supply depending on the number of times of occurrence of such an abnormal condition.

It is another object of the present invention to provide an image forming apparatus which continuously checks an abnormal condition of a power supply.

It is another object of the present invention to provide an image forming apparatus which checks an abnormal condition of a power supply in a predetermined cycle of an image forming operation.

It is another object of the present invention to provide an image forming apparatus having an additional power supply for countermeasuring to an abnormal condition of a main power supply.

The above and other objects of the present invention will be apparent from the following description of the preferred embodiments.

DETAILED DESCRIPTION OF THE PREFERRED EMBODIMENTS

Figure 1:
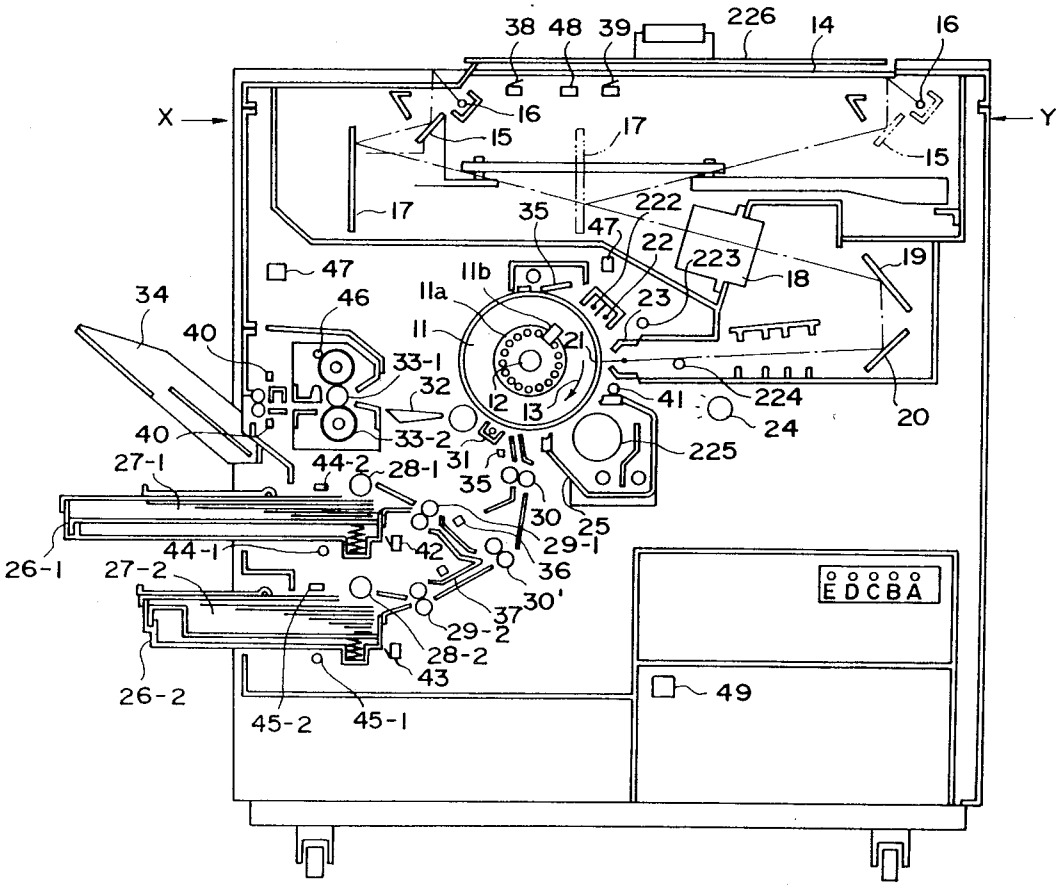
FIG. 1 shows a schematic sectional view of a copying machine to which the present invention is applied, FIG. 2 composed of FIGS. 2*a*, 2*b* and 2*c* shows a block diagram of a control circuit of the copying machine of FIG. 1.

A general construction of a copying machine to which the present invention is applied is shown in FIG. 1. In the copying machine shown, a drum 11 having a three-layer photosensitive material including CdS photosensitive material, on a surface thereof is rotatably supported by a shaft 12, and it is rotated in a direction of an arrow 13 in response to a copy command. As the drum 11 is rotated to a predetermined angular position, a text mounted on a text mount glass 14 is illuminated by an illumination lamp 16 which is in union with a first scanning mirror 15 and a reflected light therefrom is scanned by the first scanning mirror 15 and a second scanning mirror 17. The first scanning mirror 15 and the second scanning mirror 17 are moved at a velocity ratio of 1 to ½ so that the text is scanned with an optical path length forward of a lens 18 being always kept constant.

The reflected light image of the text is transmitted through the lens 18, a third mirror 19 and a fourth mirror 20 and focused on the drum 11 at an exposing station 21. The drum 11 is charged positively, for example, by a primary charger 22 and then slit-exposed by the reflected light image formed by the illumination by the illumination lamp 16 at the exposing station 21, discharged by a charge-remover 23 at the opposite polarity or a negative polarity, for example, to that of the AC or primary charger, and then it is blank-exposed by a blank exposure lamp 24 to form a high contrast electrostatic latent image on the surface thereof. The latent image is then developed to a toner image by a developing unit 25.

On the other hand, a record paper 27-1 or 27-2 in a cassette 26-1 or 26-2 is fed into the machine by a paper feed roller 28-1 or 28-2 and fed toward the photosensitive drum 11 while it is coarsely timed by a first registration roller 29-1 or 29-2 and exactly timed by a second registration roll 30 which responds to a signal from a sensor 39 which detects a specified position of the paper in the optical system, so that the leading edges of the record paper and the toner image are registered.

Then, the toner image on the drum 11 is transferred to the record paper 27 while it passes through an area between a transfer charger 31 and the drum 11. After the transfer, the record paper 27 is fed to a conveyer belt 32, thence to a pair of fixing rollers 33-1 and 33-2 where the toner image is fixed by heating. The record paper is then ejected to a tray 34.

After the transfer, the drum 11 is cleaned by a cleaning blade 35 such as an elastic blade to prepare for a next copying operation.

In order to control the image forming cycle at the respective operation points, a drum clock pulse DCK is generated by a sensor 11*b* which optically senses a clocking point of a clocking disc 11*a* rotated with the drum 11.

Prior to the image forming cycle, the drum 11 is rotated after a power switch MS was turned on to erase remaining charges and remaining latent image on the surface of the drum 11 by a pre-exposure lamp 223 and an AC pre-charge-remover 222 and the drum surface is cleaned by the cleaning roller and the cleaning blade 35. This is called a pre-rotation cycle. The pre-rotation cycle is a preparation cycle for maintaining a proper sensitivity of the photosensitive layer on the drum 11 and assuring the formation of an image on a clean surface. The rotating speed and rotating time of the pre-rotation of the drum 11 are automatically varied depending on the conditions.

On the other hand, after a preset number of copying cycles preset by a numeric key have been completed, the drum 11 is rotated several revolutions to eliminate the remaining charges and the remaining latent image on the surface of the drum 11 by the AC charger 23 in order to clean the surface of the drum 11. This is called a post-rotation cycle. The post-rotation cycle cleans the drum 11 electrostatically and physically to prepare for a next copy operation.

Sensors 36 and 37 are provided to detect misfeed and skew of the record paper 27 to be fed from the upper cassette 26-1 or the lower cassette 26-2, a sensor 38 is provided to detect jamming of the paper in the vicinity of the transfer station, and a sensor 39 is provided to detect jamming of the paper in the vicinity of the fixing station. Those sensors detect the reflected light from the record paper 27 when it passes there through to produce detection output signals.

An operation in the event when an abnormal condition of a power supply voltage of the copying machine occurs will now be explained with reference to FIGS. 2 to 5.

Figure 2A:
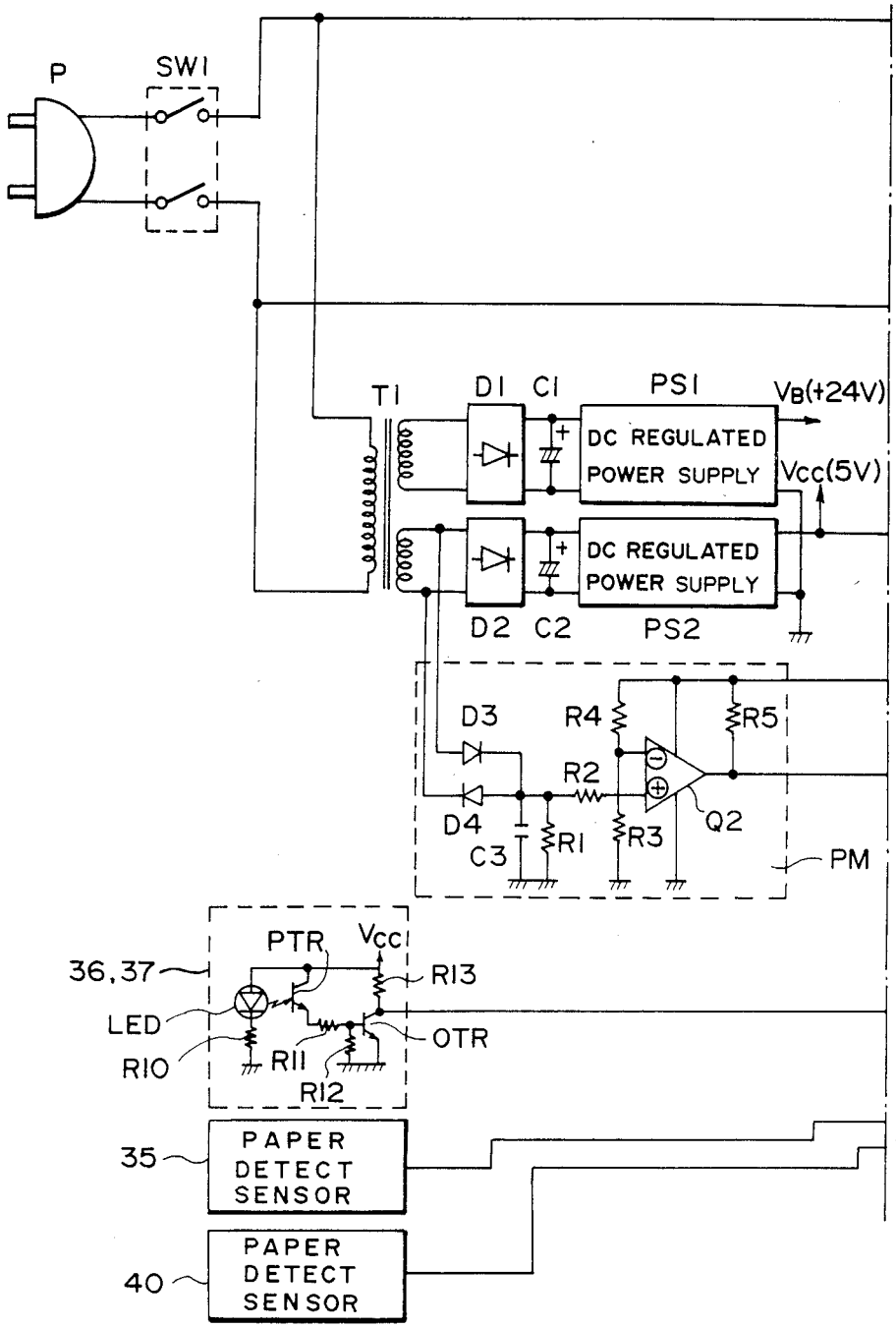
FIG. 2A shows a circuit diagram of a transistor array shown in FIG. 2.
Figure 2B:
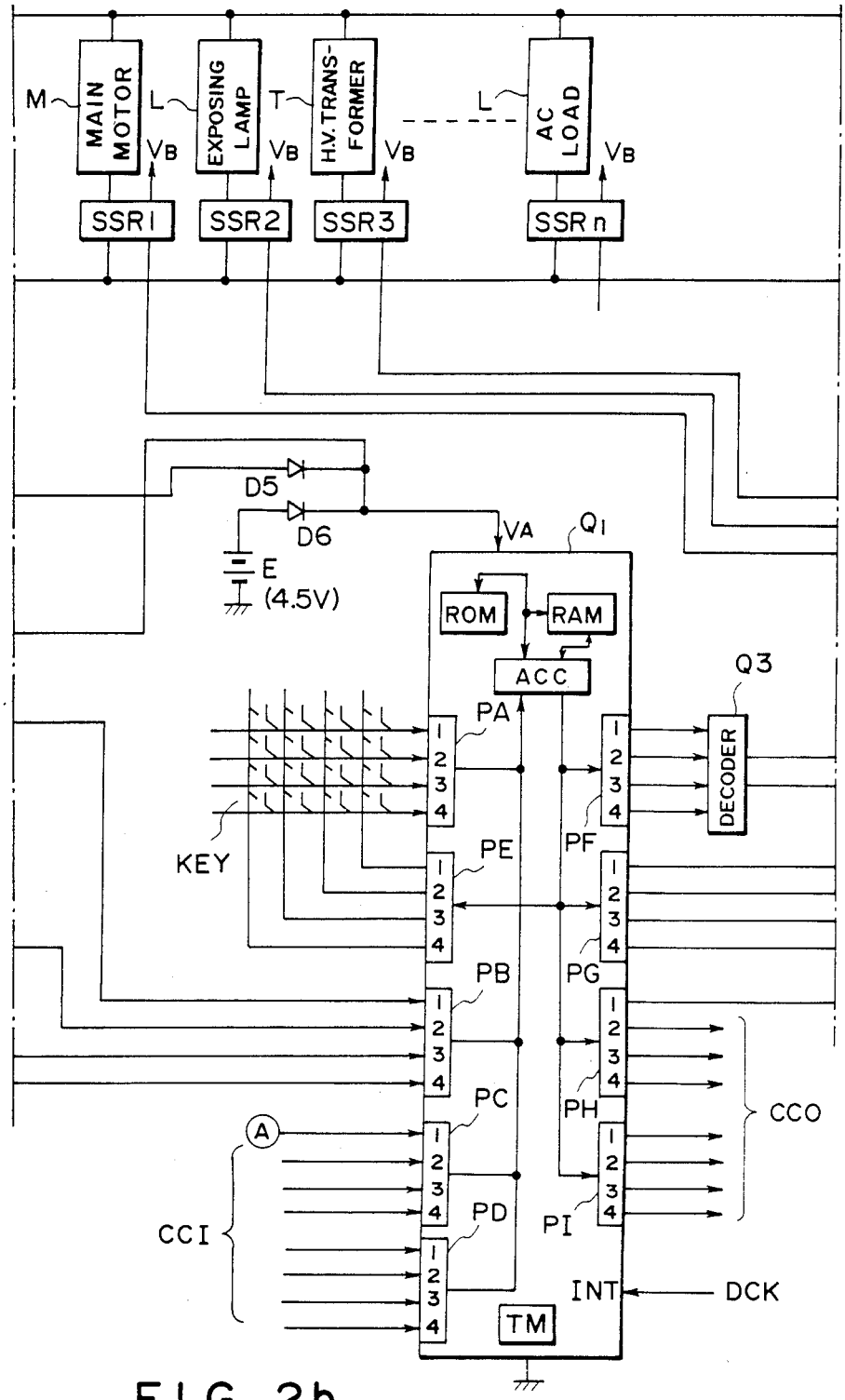

FIG. 2 shows a major portion relating to the present invention, of a control circuit of the copying machine shown in FIG. 1. In the circuit of FIG. 2, an AC power supply voltage is supplied from a power plug P connected to a power supply, through a main switch SW1 to AC loads such as a main motor M, an exposure lamp L, a high voltage transformer T and a fixing heater. The loads M, L, T, H, . . . , L are connected to solid-state relays SSR1, SSR2, SSR3, SSR4, . . . , SSRn which are on-off control elements. The AC power supply voltage is also supplied to diode bridges D1 and D2 and capacitors C1 and C2 through a low voltage transformer Tl and rectified D.C. voltages are supplied to DC regulated power supplies PS1 and PS2 which supply power to the control circuit of the copying machine. More particularly, a DC power supply voltage $V_B$ (+24 V) for DC loads such as solenoids and clutches and a DC power supply voltage Vcc (+5 V) for the control circuit are provided. The AC voltage at the input of the diode bridge D2 is full-wave rectified by diodes D3 and D4 of a power supply monitor PM, then it is smoothened by a resistor R1 and a capacitor C3 and supplied to a ⊕ terminal of a comparator Q2 through a resistor R3. An output voltage of the DC regulated power supply PS2, divided by resistors R3 and R4 is supplied to a ⊖ terminal of the comparator Q2. An output terminal of the comparator Q2 is connected through a resistor R5 to a diode D5 to which the output voltage of the DC regulated power supply PS2 is supplied, and also connected to a terminal PB1 of an input port PB. The diodes D3 and D4, the capacitor C3, the resistors R1–R5 and the comparator Q2 constitute the AC power supply monitor circuit PM. The capacitor C3 of the filtering circuit has a smaller capacitance than that of an ordinary filtering circuit so that the monitor circuit PM can rapidly respond to a change to an abnormal condition of the input AC power supply such as voltage drop of momentary break. Accordingly, when the AC power supply voltage is in a normal condition, a potential at the ⊕ terminal of the comparator Q2 to which the AC power supply voltage, after being rectified, is supplied is higher than a potential at the ⊖ terminal to which the reference DC voltage from the DC regulated power supply PS2, after being divided, is supplied. However, when the abnormal condition of the AC power supply such as the voltage drop or the momentary break occurs, the relative potentials at the input terminals of the comparator Q2 are reversed and the output terminal of the comparator Q2 assumes a low logical level L.

On the other hand, a controller Q1 of the copying machine to which the respective voltages are supplied may be a well known one-chip microcomputer which comprises a read-only memory ROM containing a necessary control program, a random access memory RAM for storing various data, an accumulator ACC and input/output ports for inputting and outputting various control signals. The input ports PA, PB, PC and PD and the output ports PE, PF, PG, PH and PI are of 4-bit configuration. The input port PA is used to input various key inputs necessary for the copy operation such as the number of copies, a cassette selection signal and a copy button signal. The output of the comparator Q2 of the power supply monitor PM is supplied to a terminal PB1 of the input port PB, the outputs of the paper sensors 36 and 37 are supplied to a terminal PB2, a detection output of a paper sensor 35 is supplied to a terminal PB3 and a detection output of a paper sensor 40 is supplied to a terminal PB4. The paper sensors 36, 37, 35 and 40 are of the same circuit configuration and they may be reflection type sensors having light emitting diodes LED and photo-transistors PTR. When the photo-transistor PTR detects the paper, it drives an output transistor OTR which produces a low logical level detection output, which is supplied to the input port PB to normally keep the terminal of the input port PB at a high logical level. Copy control inputs CCI such as other sensor outputs and timing signals necessary for the copy control are supplied to the other input ports PC and PD.

On the other hand, a timing signal to the key operation is outputted from the output port PE of the controller Q1 so that the key input is supplied to the input port PA at that timing. The output port PF is connected through a segment decoder Q3 to a segment display DSP which displays the number of copies made (COPY) and a preset number of copies to be made (SET). A terminal PG1 of the output port PG is connected to an output terminal of a comparator Q4 of a fixing heater control circuit THC through a transistor array A1 which functions as an amplifier. A temperature detection output voltage of a thermister TH coupled to a fixing heater H is supplied to a ⊖ terminal of the comparator Q4 and it is compared with the reference DC voltage $V_B$, after divided by resistors R7 and R8, supplied to a ⊕ terminal. When the fixing heater H reaches a predetermined temperature, an output of the comparator Q4 assumes a low logical level L. The output of the comparator Q4 is connected through a transistor array A6 to a solid-state relay SSR4 which energizes the fixing heater H. When the output of the comparator Q4 assumes the low logical level L, the solid-state relay SSR4 is turned off to deenergize the fixing heater H, and when the temperature of the fixing heater H falls below a predetermined temperature, the output of the comparator Q4 assumes a high logical level and the solid-state relay SSR4 is driven so that the fixing heater H is energized to be heated to the predetermined temperature. The output of the comparator Q4 is also connected to the terminal PC1 of the input port PC of the controller Q1 so that the controller Q1 can determine the heating status of the fixing heater H. Since the terminal PG1 of the output port PG of the controller Q1 is connected to the output terminal of the comparator Q4 through the transistor array A1 as described above, if the output port terminal PG1 of the controller Q1 assumes the high logical level H when the output of the comparator Q4 is at the high logical level H and the fixing heater H is being energized, the heating of the fixing heater H is accelerated to rapidly raise the temperature and then the fixing heater H is forcibly deenergized. R6–R9 in the fixing heater control circuit THC denote resistors.

An output port terminal PG2 of the controller Q1 is connected to a solid-state relay SSRl for a main motor M through a transistor array A2, an output port terminal PG3 is connected to a solid-state relay SSR2 for the exposure lamp L through a transistor array A3 and an output port terminal PG4 is connected to a solid-state relay SSR3 for the high voltage transformer T through a transistor array A4. A terminal PH1 of the output port PH is connected to an alarm lamp ALM for alarming the voltage drop or the momentary break through a transistor array A5. The other output port terminals PH2–PH4 and the output port PI produce the copy control outputs CCO such as a paper feed timing signal, an optical system drive signal and other drive signals necessary for the copy control. The drum clock pulse DCK described above is supplied to an interrupt terminal INT of the controller Q1, which produces a timing signal for the copy control of the image formation.

Applied to a power supply terminal $V_A$ of the controller Q1 are the regulated DC power supply voltage from the DC regulated power supply PS2 and an auxiliary power supply voltage from an auxiliary power supply E such as a battery, through back-flow preventing diodes D5 and D6. The auxiliary power supply voltage E is set to be slightly lower than the regulated DC power supply voltage Vcc so that the power of the auxiliary power supply E is not consumed when the DC power supply voltage Vcc is normal. The auxiliary power supply may be a solar battery. The power supply voltage supplied to the controller Q1 is common to the DC power supply voltage Vcc supplied to the power supply monitor circuit PM and the alarm circuit ALM. Thus, when the abnormal condition of the power supply such as the voltage drop or the momentary break occurs, the auxiliary power supply voltage from the auxiliary power supply E is supplied to the controller Q1 as well as to the power supply monitor circuit PM and the alarm circuit ALM so that they can maintain the normal operation. The rotations of the drum and the rollers may be controlled by the auxiliary power supply E to eject the record paper so that the normal operation can be immediately started after the normal power supply condition has been recovered. The transistor arrays A1–A6 each may comprise resistors R14–R16 and transistors TR1 and TR2 as shown in FIG. 2A.

Figure 3:
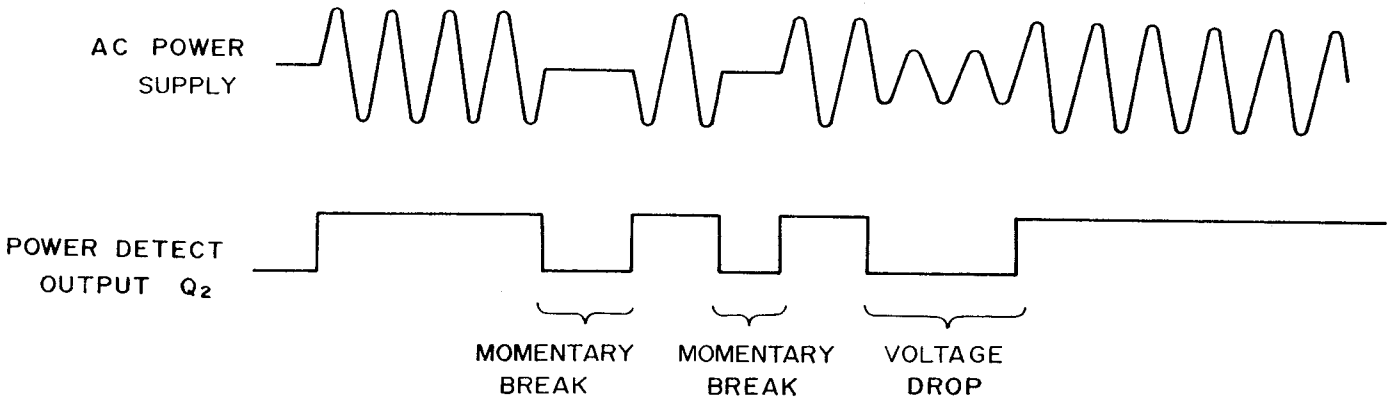
FIG. 3 illustrates abnormal conditions of an A.C. power supply, and FIG. 4 composed of FIGS. 4A, 4B, 4C and 4D, and FIG. 5 composed of FIGS. 5A and 5B show flow charts for the operation of the copying machine in accordance with the present invention.

FIG. 3 shows an example of a voltage waveform of the input AC power supply voltage to the electric circuit of the copying machine shown in FIG. 2 when the momentary break and the voltage drop occur, and a corresponding output signal waveform of the power supply monitor circuit PM from the comparator Q2. When the AC power supply voltage is normal, the power supply monitor circuit PM produces the high logical level (H) output signal, and when the abnormal condition such as the voltage drop and the momentary break occurs, it produces the low logical level (L) output signal.

Figure 4D:
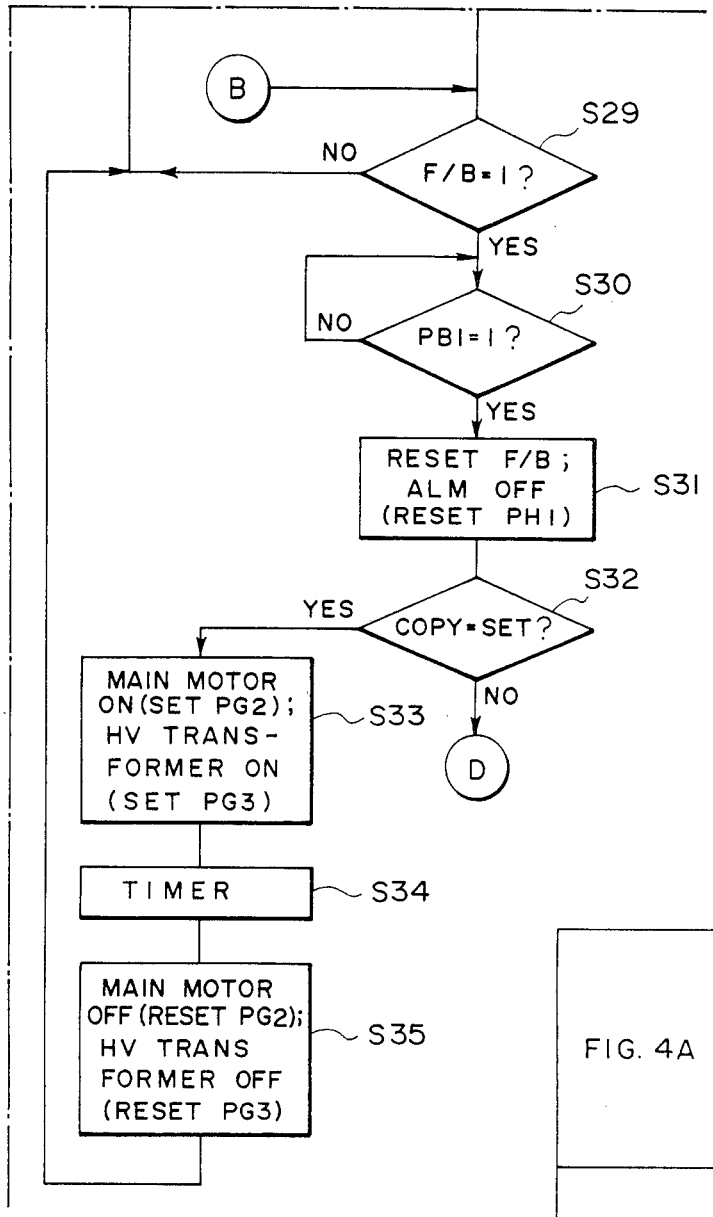
Figure 4:
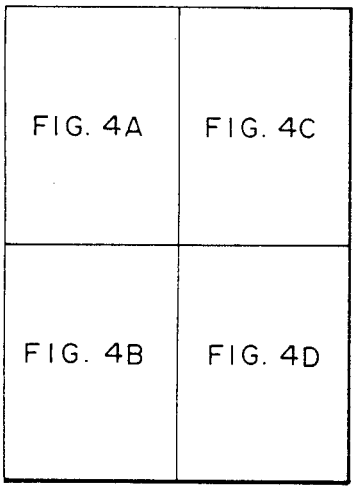
Figure 4A:
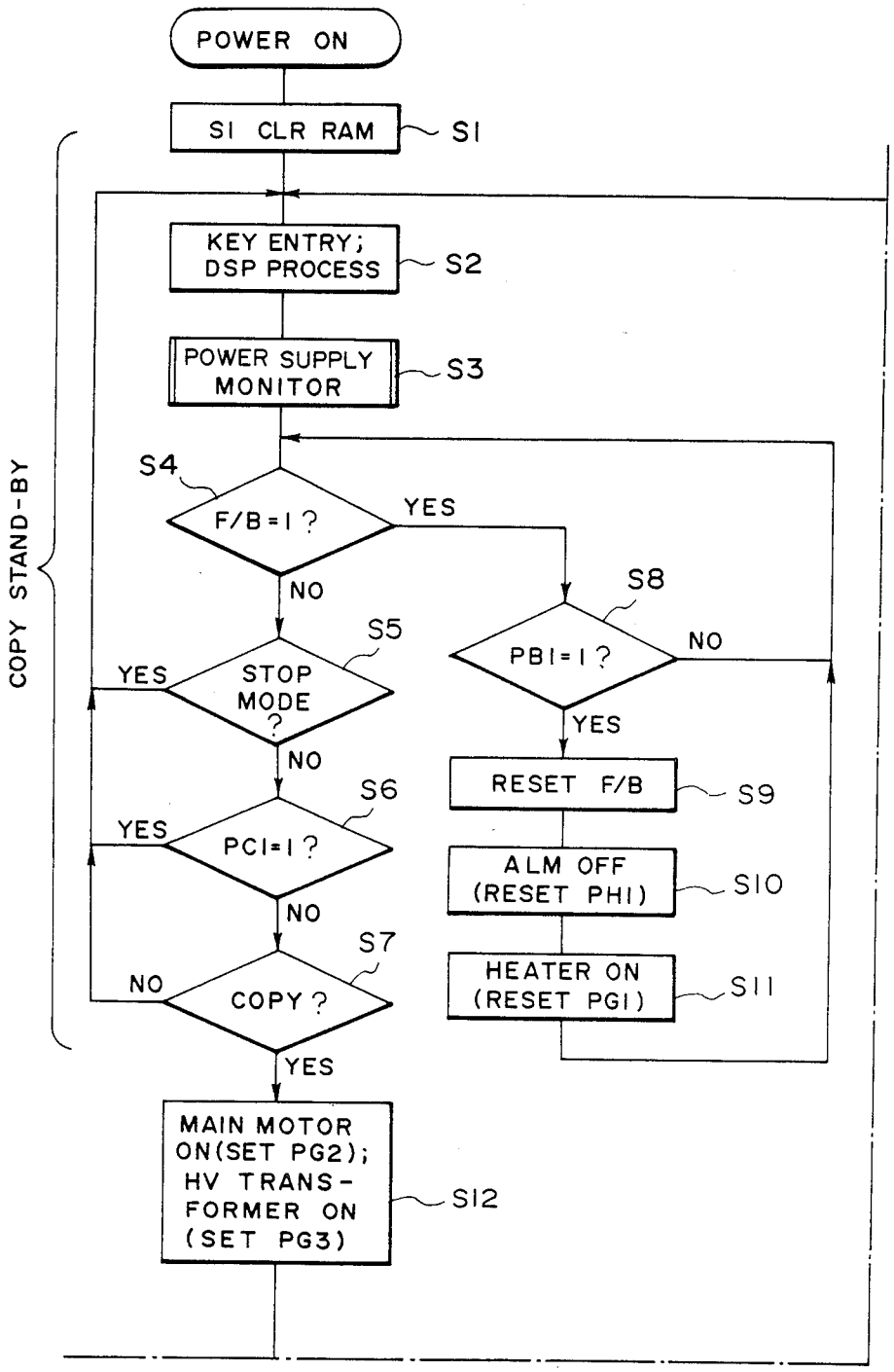
Figure 4B:
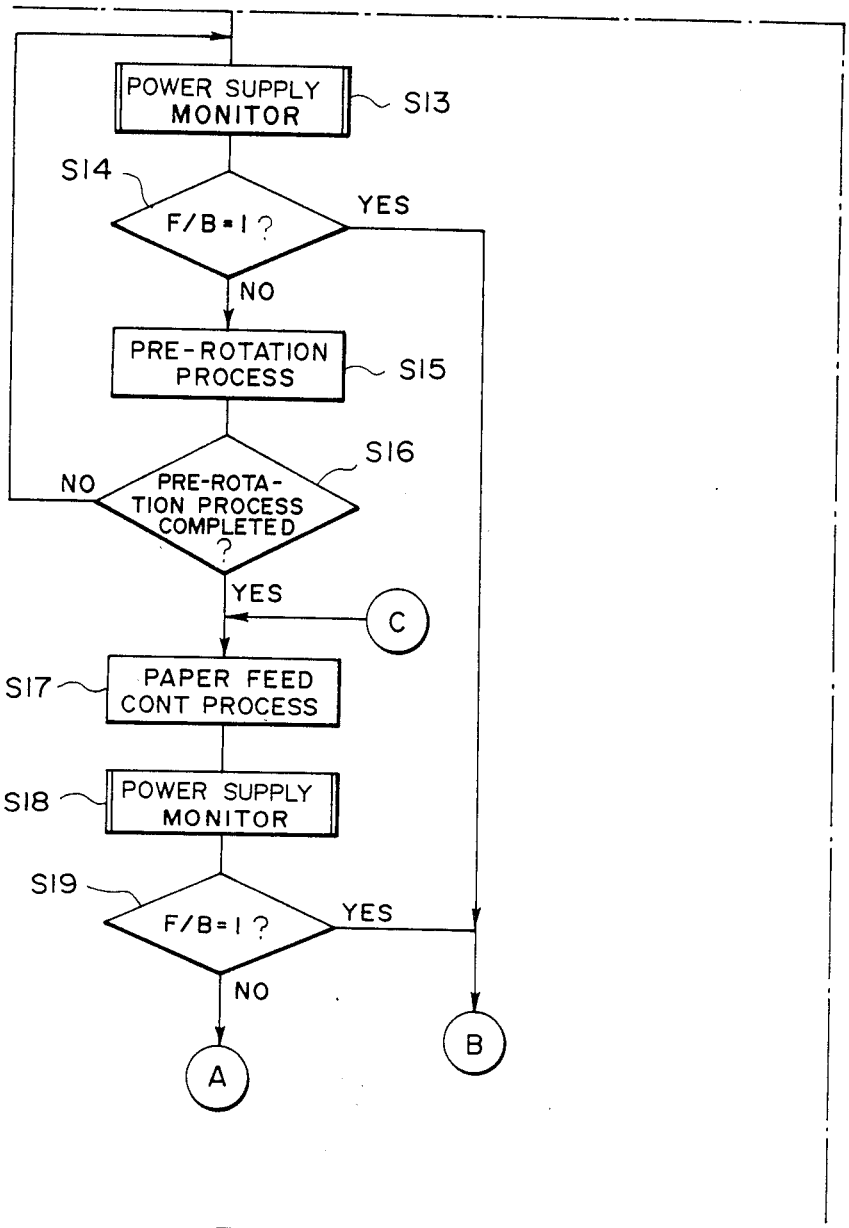
Figure 4C:
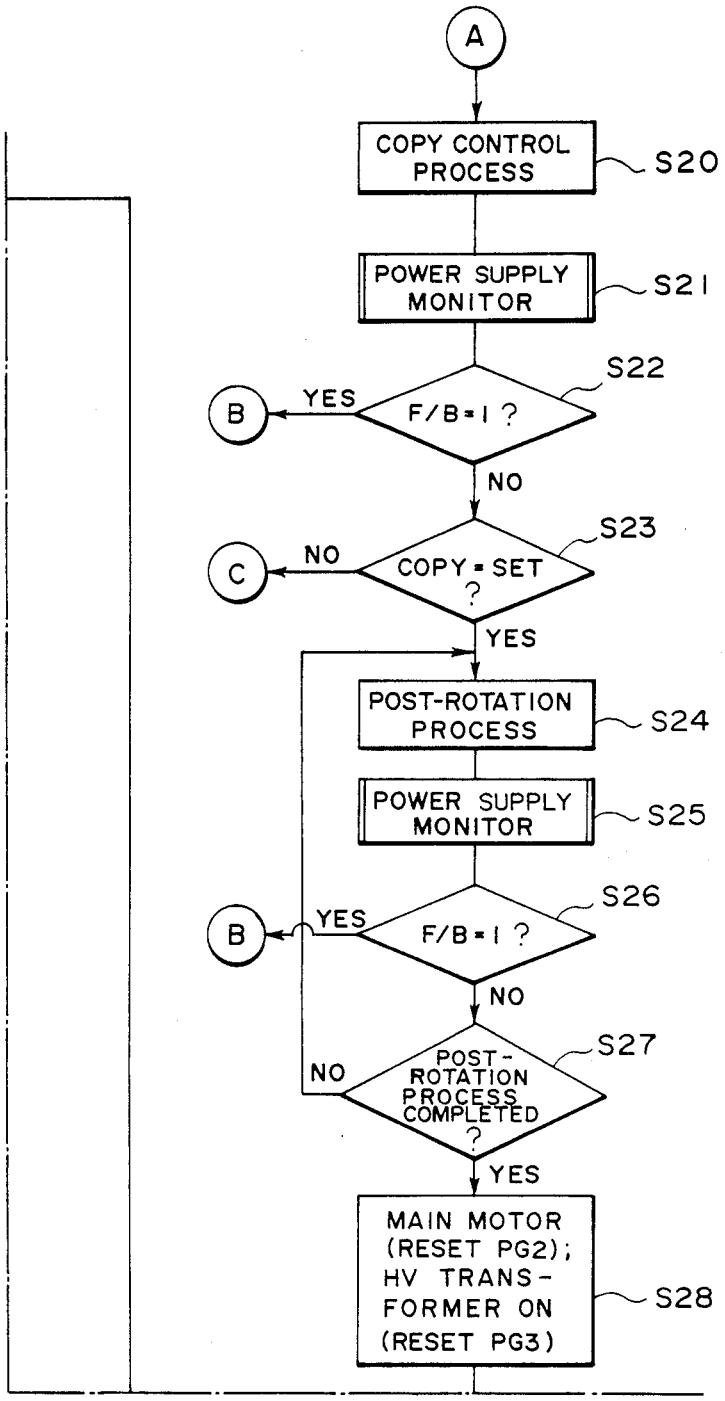
Figure 5:
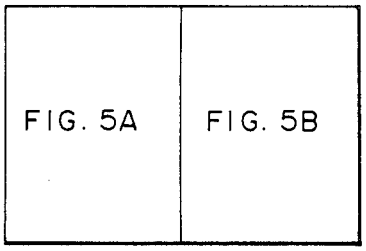
Figure 5A:
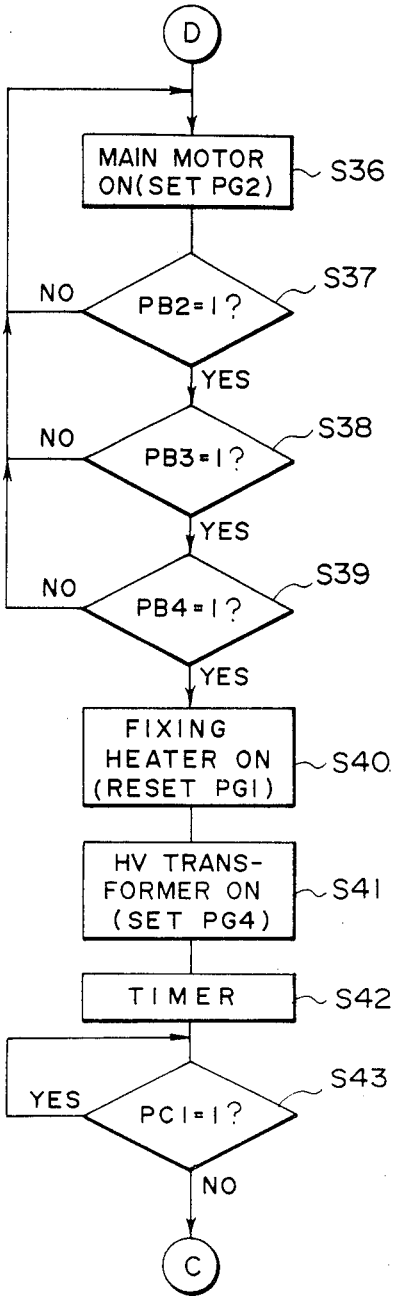
Figure 5B:
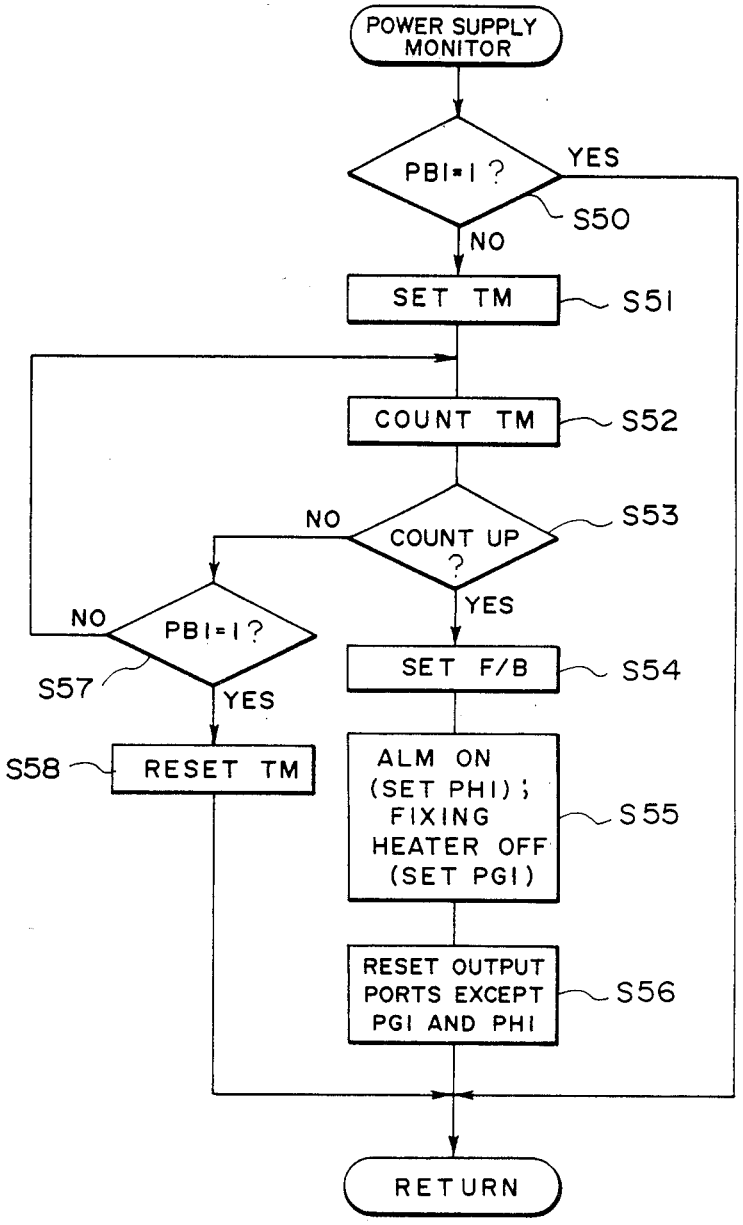

FIGS. 4 and 5 show flow charts for the electric circuit of FIG. 2 which drives the copying machine. In a step 1 (S1) following to the turn-on of the power switch SW1, the random access memory RAM for the data in the controller Q1 is cleared, and in a step 2, the key inputs such as a preset number of copies, a start of copy command and a cassette select signal are entered and the preset number of copies is displayed on the segment display DSP and the cassette size is displayed. In a step 3, a power supply monitor processing is carried out in accordance with a sub-routine shown in FIG. 5. In the power supply monitor sub-routine of FIG. 5, the terminal PB1 of the input port PB is checked in a step 50 to determine if the input AC power supply voltage E is normal or not. As described above, when the input AC power supply voltage is normal, the power supply monitor output signal supplied to the input port terminal PB1 is at the high logical level H. Thus, the decision in the step 50 is "YES" and the process immediately returns to the main routine shown in FIG. 4 and a step 4 is started. If the input AC power supply voltage is in the abnormal condition such as the voltage drop or the momentary break, the input port terminal PB1 is at the low logical level L and the decision in the step 50 is "NO". Thus, the process goes to a step 51. In the step 51, a timer TM in the controller Q1 is set to 80 milliseconds which corresponds to four cycles of the 50 Hz power supply frequency. The timer TM can be set to any setting depending on the AC power supply, the DC regulated power supplies PS1 and PS2 and the drive mode of the copying machine. In a step 52, the timer is counted by an internal clock signal of the controller Q1, and in a step 53, the count-up of the timer TM is checked, and if the decision is "NO", the process goes to a step 57 where the input AC power supply voltage condition is again checked. If the input AC power supply voltage condition is not normal at the time of the count-up of the timer TM, the steps 52, 53 and 57 are repeated to continue the count of the timer TM, and when the timer TM is counted up in the step 53, the process goes to a step 54 where a flag F/B indicating the abnormal condition of the power supply is set, and in a step 55, the output port terminal PH1 is set to turn on the alarm display ALM and the output port terminal PG1 is set to deenergize the fixing heater H. Then, the process goes to a step 56. In the step 56, all of the output port terminals other than the output port terminals PH1 and PG1 are reset. Thus, when the copying machine is in the copy operation, the main motor and the exposure lamp are immediately deenergized to prevent the damage to the copying machine due to the mulfunction at the abnormal condition of the input AC power supply such as the voltage drop and the momentary break. The conveying roller may be driven by the auxiliary power supply to eject the remaining record paper.

On the other hand, if the normal AC power supply condition is recovered in the course of the counting of the timer TM in the steps 52, 53 and 57 of the timer counting routine, the decision in the step 57 is "YES" and the process goes to a step 58 where the timer TM is reset, and the process returns to the main routine. Thus, if the AC power supply condition returns to the normal condition within a predetermined time period after the detection of the abnormal condition of the AC power supply voltage, it is not regarded as the abnormal condition so that the interruption of the normal copy operation by the momentary break of the power supply for a very short period, which does not effectively affect to the copy operation. While the prevention of the misjudgement is done by the counting interval of the timer TM in the above description, the number of times of the occurrence of the power supply abnormal condition signals may be counted and the interruption of the copying operation is inhibited if the normal condition is recovered before the count reaches a predetermined count.

When the power supply monitor sub-routine is completed, the process goes to a step 4 from the step 3. In the step 4, the flag F/B is checked to determine if the power supply condition is abnormal or not. If the flag F/B was set (F/B="1") in the step 3 as a result of the detection of the abnormal condition of the power supply by the power supply monitor circuit PM, the process goes to a step 8 where the output of the power supply monitor circuit PM is checked to determine if the normal condition of the power supply has been recovered, and if it has not been recovered, the steps 4 and 8 are repeated until the normal power supply condition is recovered. When the normal power supply condition is recovered, the flag F/B is reset in a step 9, and in steps 10 and 11 the output port terminal PH1 is reset to turn off the alarm display ALM and the output port terminal PG1 is reset to energize the fixing heater H. Then, the process goes to a step 5 through the step 4. In the step 5, a mode is checked to determine if it is a stop mode, for example, the presence or absence of the papers in the cassette and the presence or absence of a jam are checked, and if it is not the the process goes to a step 6 where the control signal supplied from the fixing heater control circuit THC to the input port terminal PC1 is checked to determine if the fixing heater H has reached a predetermined fixing temperature. If it has been reached the process goes to a step 7 where the depression of the copy button is checked. The steps up to the step 7 are stand-by cycle. Even if the abnormal condition of the input AC power supply such as the voltage drop and the momentary break occurs during the stand-by cycle, the stand-by cycle can be continued without trouble if the abnormal condition of the power supply disappears.

If the depression of the copy button is detected in the step 7, the process goes to a step 7 where the output port terminal PG2 is set to energize the main motor M to start the copy operation, and the output port terminal PG3 is set to energize the high voltage transformer T. Then, the process goes to a step 13. In the step 13, the power supply monitor sub-routine is again executed as is done in the step 3, and in a step 14 the flag F/B is checked to determine if the power supply condition is abnormal or not. If it is abnormal, all of the output port terminals of the controller Q1 are reset in the power supply monitor sub-routine to immediately stop the copy operation, turn on the alarm display ALM and deenergize the fixing heater H. Then, the process goes to a step 29. If the result of the check of the flag F/B in the step 14 indicates no occurrence of the abnormal condition of the power supply, the process goes to a step 15 where the pre-rotation processing, that is, the pre-cleaning of the photo-sensitive drum is carried out, and the completion of the pre-rotation processing is checked in a step 16. If the pre-rotation processing is completed, a paper feed control processing to feed the record paper from the cassette is carried out in a step 17. In steps 18 and 19, the flag F/B is checked to determine if the abnormal condition of the power supply was detected by the power supply monitor, and if it was not detected, the process goes to a step 20 where the copy control processing, that is, a series of image forming steps including the development of the latent image on the photo-sensitive drum by the exposure of the text, the fixing of the latent image and the transfer of the image to the record paper to form a record, are carried out. In steps 21 and 22, the power supply condition is checked, or alternatively the power supply monitor sub-routine may always be executed in the copy control processing. In a step 23, the completion of the number of copies preset by an operator is checked, and if they are completed, the post-rotation processing is carried out in a step 24 and the power supply condition is checked in steps 25 and 26, and the completion of the post-rotation processing is checked in a step 27. If it is completed, the output port terminals PG2 and PG3 are reset in a step 28 to deenergize the main motor M and the high voltage transformer T, and the process goes to the step 2 of the copy stand-by cycle through a step 29.

The copy cycle has been described above. If the abnormal condition of the power supply occurs in the copy cycle, the process goes to the step 29. Since the main motor M and the high voltage transformer T have been deenergized and the other copy control signals have been turned off, the alarm display ALM has been turned on and the fixing heater H has been deenergized at this moment in the power supply monitor sub-routine in order to stop the copy operation, the decision in the step 29 is "YES" and the process goes to a step 30 where the recovery of the normal condition of the power supply is checked. If it has recovered, the flag F/B is reset in a step 31 and the output port terminal PH1 is reset to turn off the alarm display ALM. At this moment, the fixing heater has not yet been energized. In a step 32, the completion of the preset number of copies is checked. When the abnormal condition of the power supply occurs during the copy operation and the copy operation is immediately stopped, no record paper will remain in the feed path if all of the preset number of copies have been completed and the record papers have been ejected. However, if the copy operation is stopped in the course of the copying of the preset number of copies, the record paper will remain in the feed path. If the feed path is long, several record papers will remain, and the record paper may remain while it is wrapped around the fixing heater H. In such a case, unless the fixing heater H is forcibly deenergized, the record paper may be burnt or wrapped around the fixing roller to damage it. If the predetermined number of copies have been completed in the step 32, the process goes to a step 33 where the main motor M and the high voltage transformer T are energized, and in a step 34 the timer TM is counted for a predetermined time period, and when the timer TM is counted up, the main motor M and the high voltage transformer T are deenergized in a step 35 and the process goes back to the step 2 to start the next copy stand-by routine. In the steps 33, 34 and 35, the cleaning rotation of the photo-sensitive drum is effected for the predetermined time period. If the copy operation is stopped in the course of the formation of a predetermined potential on the photo-sensitive drum to form the latent image and the function of the photo-sensitive drum is stopped, the latent image on the photo-sensitive drum is non-uniform and it appears as a stored image in the next latent image formation cycle. The cleaning rotation prevents such an adverse affect. In the present invention, when the normal condition of the power supply is recovered after the abnormal condition of the power supply occurred during the copy operation and the copy operation was stopped, the cleaning rotation of the photo-sensitive drum is automatically carried out for the predetermined time period to prevent the ununiform charge of the photo-sensitive drum. If the decision in the step 32 is "NO", the process goes to a step 36 of FIG. 5 where the output port terminal PG2 is set to energize the main motor M. As described above, if the copy operation is stopped in the course of the operation, the record paper remains in the feed path. Accordingly, the main motor M is energized to drive the feed mechanism to eject the record paper out of the feed path. This remaining paper ejection operation is continued until the paper sensor arranged in the feed path detects the ejection of all of the remaining papers in steps 37, 38 and 39. When the ejection is completed, the output port terminal PG1 is set in a step 40 to energize the fixing heater H. By energizing the fixing heater H after all of the remaining record papers have been ejected, the burning of the fixing heater roller by the remaining record paper or the burning of the remaining record paper is prevented. Then, in a step 41, the high voltage transformer T is energized to carry out the cleaning rotation of the photo-sensitive drum and the temperature of the fixing unit is checked to determine if it has reached a predetermined fixing temperature.

The cleaning rotation is continued until the fixing unit reaches, the predetermined fixing temperature, and when it is reached, the process goes to a step 37 where the remaining copy operation is carried out to control the paper feed and resume the copy operation.

As described hereinabove, according to the present invention, the condition of the AC power supply to the recording apparatus is always monitored, the drive power for the monitor control circuit is always maintained by the auxiliary power supply, and when the abnormal condition of the power supply such as the voltage drop or the momentary break is detected during the record operation or the non-record operation, the record operation is immediately interrupted, if it is detected during the record operation, to prevent the affect to the recording apparatus by the voltage drop or the momentary break and the remaining record operation is automatically resumed when the normal power supply condition is recovered and the cleaning rotation of the photo-sensitive drum is automatically carried out when the record operation is resumed to automatically eject the record paper remaining in the feed path at the time when the record operation was interrupted, and the fixing heater is energized after the ejection. Even if the abnormal condition such as the voltage drop or the momentary break which does not affect to the drive control of the recording apparatus is detected, the record operation is not interrupted so that the record operation is carried out at an optimum condition to the abnormal condition of the power supply.

What is claimed is:

1. An image forming apparatus comprising:

means for supplying power;

image forming means coupled to said power supply means for carrying out a predetermined image forming operation;

control means coupled to said image forming means for controlling said image forming operation; and means for detecting an abnormal power condition of said power supply means, wherein said detecting means is coupled to said control means, and wherein said control means stops said image forming means upon detection of the abnormal power condition by said detecting means, and said control means causes said image forming means to perform a paper ejection operation upon recovery from the abnormal power condition.

2. An image forming apparatus according to claim 1, wherein said control means continues to stop said image forming means after the paper ejection operation is performed.

3. An image forming apparatus according to claim 1, wherein said control means, after the paper ejection operation is performed, causes said image forming means to execute the image formation in process at the time the abnormal condition is detected.

4. An image forming apparatus according to claim 1, wherein said control means enables a fixing heater after the paper ejection operation is performed.

5. An image forming apparatus according to claim 1, wherein said power supply means comprises an AC power supply means.

6. An image forming apparatus comprising:

means for supplying power;

means coupled to said power supply means for carrying out a predetermined image forming operation including a paper ejection operation;

means coupled to said image forming means for controlling said image forming operation; and means for detecting an abnormal power condition of said power supply means wherein said detecting means is coupled to said control means, and wherein when the abnormal power condition is detected by said detecting means, said image forming means is stopped after the paper ejection operation is performed.

7. An image forming apparatus according to claim 6, wherein said paper ejection is performed by a second power supply means.

8. An image forming apparatus according to claim 6, wherein immediately after recovery from the abnormal condition, said control means causes said image forming operation, in process before the abnormal condition occurs, to resume.

9. An image forming apparatus according to claim 6, wherein said power supply means comprises an AC power supply.

* * * * *

UNITED STATES PATENT AND TRADEMARK OFFICE

CERTIFICATE OF CORRECTION

PATENT NO. : 4,569,585

DATED : February 11, 1986

INVENTOR(S) : SHUNICHI MASUDA

It is certified that error appears in the above-identified patent and that said Letters Patent is hereby corrected as shown below:

COLUMN 1

Line 14, "In" should be --If--.
Line 15, "broken" should be --breaks down--.
Line 54, "momentarily" should be --momentary--.
Line 63, "affect to" should be --influence--.

COLUMN 4

Line 6, "there through" should be --therethrough--.
Line 48, "of" should be --or--.

COLUMN 5

Line 37, "after" should be --which voltage is first--.
Line 38, "R8," should be --R8 and then--.

COLUMN 7

Line 37, "mulfunction" should be --malfunction--.
Line 54, ", which does not effectively affect to" should be --does not effectively influence--.

UNITED STATES PATENT AND TRADEMARK OFFICE

CERTIFICATE OF CORRECTION

PATENT NO. : 4,569,585

DATED : February 11, 1986

INVENTOR(S) : SHUNICHI MASUDA

It is certified that error appears in the above-identified patent and that said Letters Patent is hereby corrected as shown below:

COLUMN 8

Line 16, "the the" should be --the stop mode, the--.
Line 30, "step 7 where" should be --step 12 where--.

COLUMN 9

Lines 58 to 59 "ununiform" should be --non-uniform--.

COLUMN 10

Line 14, "reaches, the" to --reaches the--.
Line 38, "affect to" should be --affect--.
Line 41, "to" should be --regardless of--.

Signed and Sealed this

Tenth Day of March, 1987

*Attest:*

*Attesting Officer*

DONALD J. QUIGG

*Commissioner of Patents and Trademarks*